8-109 SR
FIP8309 XR 3,979,312

United States Patent [19]
Nakagawa et al.

[11] 3,979,312
[45] Sept. 7, 1976

[54] DETERGENT COMPOSITION CONTAINING NOVEL BLEACHING AGENT

[75] Inventors: Yunosuke Nakagawa, Koshigaya; Shigetsugu Sugiura, Tokyo; Kinjiro Matsunaga, Funabashi; Yoshio Ito, Kohriyama, all of Japan

[73] Assignees: Kao Soap Co., Ltd.; Nippon Peroxide Co., Ltd., both of Tokyo, Japan

[22] Filed: July 7, 1975

[21] Appl. No.: 593,203

[30] Foreign Application Priority Data

July 12, 1974 Japan ..... 49-79967

[52] U.S. Cl. ..... 252/99; 8/109; 252/95

[51] Int. Cl.[2] ..... C11D 3/395; C11D 7/54

[58] Field of Search ..... 8/109; 252/95, 99

[56] References Cited

UNITED STATES PATENTS 3,663,444 5/1972 Schmadel ..... 252/99

OTHER PUBLICATIONS

Chemical Abstracts, vol. 69, 1968, p. 52909 X.

*Primary Examiner*—Mayer Weinblatt
*Assistant Examiner*—Edith R. Buffalow
*Attorney, Agent, or Firm*—Woodhams, Blanchard and Flynn

[57] ABSTRACT

A neutral detergent composition containing a bleaching agent having the formula:

$$4Na_2SO_4.2H_2O_2.NaCl$$

3 Claims, No Drawings

DETERGENT COMPOSITION CONTAINING NOVEL BLEACHING AGENT

BACKGROUND OF THE INVENTION

1. Field of the Invention

This invention relates to a neutral detergent composition containing a bleaching agent.

2. Description of the Prior Art

Various bleaching agents have heretofore been incorporated into detergents so as to attain a bleaching or sterilizing effect as well as a washing effect during clothes washing. When bleaching agents are incorporated into household detergents which are stored for a long time, they are required to have a sufficient storage stability. It is also required that they should not cause such undesired phenomena as yellowing or discoloration of various kinds of fibers used in clothing.

As such bleaching agents, there have heretofore been employed sodium perborate and sodium percarbonate. However, because each of these two bleaching agents is highly alkaline, in order to obtain a long-time storage stability, the detergents to which they can be added are limited to alkaline detergents, namely, the so-called heavy-duty detergents.

use of heavy-duty detergents is generally preferred for washing clothes composed of such fibers as cotton fibers and polyester fibers, but when fine clothes made of wool, silk or nylon are washed with these heavy-duty detergents, yellowing of such clothes occurs or a rough and hard touch is imparted to the washed clothes. Accordingly, in order to wash clothes of these latter fibers, it is customary to employ the so-called light-duty detergents. However, because sodium perborate and sodium percarbonate are unstable in neutral detergents as described hereinbefore, it is not permissible to incorporate these bleaching agents in neutral light-duty detergents. Further, known neutral bleaching agents such as peroxyurea and sodium sulfate-hydrogen peroxide adduct are similarly unstable.

It is therefore a primary object of this invention to provide a neutral detergent composition (the pH of an aqueous solution of which is about 6 to about 8) containing a bleaching agent stably incorporated therein.

SUMMARY OF THE INVENTION

The above object of this invention is attained by providing a neutral detergent composition containing a bleaching agent having the formula:

$$4Na_2SO_4.2H_2O_2.NaCl \quad (I)$$

The bleaching agent $4Na_2SO_4.2H_2O_2.NaCl$ is an adduct synthesized by reacting sodium sulfate with hydrogen peroxide in an aqueous solution, said method being characterized in that sodium chloride is made present in the reaction system.

The synthesis of this adduct is described in the specification of Japanese Pat. application No. 1028/74, filed Jan. 25, 1974, corresponding to U.S. Pat. Ser. No. 593,202, filed July 7, 1975, filed in the names of Ito and Mashiko, and entitled "Stable Sodium Sulfate-Hydrogen Peroxide-Sodium Chloride Adduct and Process for Preparing Same," the entire contents of which are incorporated herein by reference.

The neutral detergent composition of this invention contains the above bleaching agent of formula (I) in an amount of about 3 to about 40% by weight, preferably from 10 to 30% by weight.

The other components of the neutral detergent composition of this invention are chosen from the components customarily used in neutral or light-duty detergents. For example, the following composition can be used as the basic detergent composition into which is incorporated the above adduct of formula (I):

| | |
|---|---|
| Surfactant | about 3 to about 50% by weight |
| Neutral Inorganic Salt | about 10 to about 90% by weight |
| Alkaline Inorganic Builder Salt | 0 to about 20% by weight |
| Organic Builder | 0 to about 10% by weight |
| Optional additive substances, such as perfume, pigment, dye, sterilizer, fluorescent dye, etc. | 0 to about 3% by weight |

As the surfactant, there can be employed, for example, anionic surfactants such as alkyl sulfates containing an alkyl group having 10 to 22 carbon atoms, soaps containing an alkyl group having 10 to 22 carbon atoms, alkylsulfonates containing 10 to 22 carbon atoms, alkylbenzenesulfonates containing an alkyl group having 10 to 22 carbon atoms, alkylphenylpolyoxyalkylene ether sulfates containing an alkyl group having 8 to 22 carbon atoms, alkylpolyoxyalkylene ether sulfates containing an alkyl group having 10 to 22 carbon atoms, isothionates of fatty acids containing a hydrocarbon chain having 10 to 22 carbon atoms and monoglyceride sulfates of fatty acids having 10 to 22 carbon atoms; non-ionic surfactants such as polyoxyalkylenealkyl ethers containing an alkyl group having 10 to 22 carbon atoms, polyoxyalkylenealkylphenyl ethers containing an alkyl group having 10 to 22 carbon atoms, alkylolamides of fatty acids containing a carbon chain having 10 to 22 carbon atoms, polyoxyethylenesorbitan esters of fatty acids having 8 to 22 carbon atoms, polyethyleneglycol-fatty acid esters having a carbon chain of 8 to 22 carbon atoms and polyoxypropylene-polyoxyethylene block copolymers; and amphoteric surfactants such as alkylbetaines containing an alkyl group having 8 to 22 carbon atoms and ethoxybetaine. These surfactants can be used singly or in the form of mixtures of two or more of them. Cationic surfactants can be used according to need.

In these surfactants, it is preferred that the carbon chain constituting the hydrophobic groups be saturated, because the presence of an unsaturated hydrocarbon chain sometimes causes degradation of the stability.

The neutral inorganic builder or filler used in the neutral detergent composition of this invention includes neutral water-soluble inorganic salts such as sodium sulfate and sodium chloride, and the use of sodium sulfate is especially preferred.

In order to prevent hydrolysis of the surfactants during storage, conventional alkaline detergent builders such as salts of condensed phosphoric acids such as tripolyphosphoric acid and pyrophosphoric acid, orthophosphoric acid salts, bicarbonates and silicates can be added, but only to such an extent that the pH of the detergent composition is not higher than about 8.

Likewise, there can be employed in the detergent conventional organic builders such as ethylenediaminetetraacetic acid, its salts, nitrilotriacetic acid, its salts, carboxymethyl cellulose, polyethylene glycol, tartaric acid salts and citric acid salts.

The neutral detergent composition of this invention is very stable even if it is stored for a long time, and it can wash, bleach and sterilize fine clothes of wool, silk, nylon and the like.

This invention will now be described in detail by reference to the following illustrative Preparations and Examples.

Preparation 1

200 ml of an aqueous solution containing 25% by weight of $H_2O_2$, which was saturated with anhydrous $Na_2SO_4$, was agitated while maintaining the solution at 10°C., and in this state 50 g of NaCl was added to the solution. A white stable hydrogen peroxide adduct containing 9 to 10 wt.% of $H_2O_2$ was obtained.

Preparation 2

200 ml of an aqueous solution containing 100 g/l of $H_2O_2$ and 300 g/l of NaCl was agitated at 10°C. and 60 g of anhydrous $Na_2SO_4$ was added to the solution. Then, the mixture was agitated for 30 minutes and filtered, and the recovered solids were dried to obtain 64 g of a stable hydrogen peroxide adduct containing 8.2 to 8.5 wt.% of $H_2O_2$.

Preparation 3

200 ml of an aqueous solution containing 350 g/l of $H_2O_2$ and 230 g/l of NaCl was agitated at 25°C., and 60 g of anhydrous $Na_2SO_4$ was added thereto. The mixture was agitated for 30 minutes and filtered, and the recovered solids were dried to obtain 60 g of a stable hydrogen peroxide adduct containing 9.0 to 9.5 wt.% of $H_2O_2$.

Preparation 4

An aqueous solution containing 60% by weight of $H_2O_2$ and NaCl were added to the filtrate obtained in Example 3, so that the concentrations of hydrogen peroxide and sodium chloride were at the same levels as in the starting solution used in Example 3. Then, 54 g of anhydrous $Na_2SO_4$ was added to 200 ml of the thus-formed solution, and the mixture was treated in the same manner as in Example 3 to obtain a stable hydrogen peroxide adduct containing 9.0 to 9.5 wt.% of $H_2O_2$.

Preparation 5

200 ml of an aqueous solution containing 300 g/l of $H_2O_2$ and 50 g/l of NaCl was maintained at 40°C. and 100 g of anhydrous $Na_2SO_4$ was added to the solution. The mixture was treated in the same manner as in Example 3 to obtain a stable hydrogen peroxide adduct containing 10.0 to 10.5 % of $H_2O_2$.

Preparation 6

Sodium sulfate and sodium chloride were used in the amounts described in the following Table 1. They were mixed with 100 ml of 30 per cent hydrogen peroxide aqueous solution and dissolved therein on a water bath maintained at 40°C. The solution was concentrated at 40°C. under reduced pressure. At this time the crystals were precipitated, followed which the crystals were separated and dried. The thus obtained crystals were analyzed with X-ray diffraction and chemical analysis. The results are shown in Table 3.

Table 1

| Test No. | | 6-1 | 6-2 |
|---|---|---|---|
| Amount of sodium sulfate | | 14.20 g | 10.65 g |
| Amount of sodium chloride | | 5.42 g | 16.35 g |
| Molar ratio of sodium sulfate to sodium chloride | | 1:1 | 1:4 |
| X-ray diffraction | sodium chloride | – | – |
| | sodium sulfate | – | – |
| | $Na_2SO_4.nH_2$ | – | – |
| | novel diffraction pattern | + | + |
| Chemical analysis | hydrogen peroxide | 9.71% | 9.54% |
| | sodium chloride | 8.56% | 9.10% |
| | sodium sulfate | 81.73% | 81.36% |
| Composition calculated from the above data | | Mol Ratio | |
| | hydrogen peroxide | 1.985 | 1.958 |
| | sodium chloride | 1.018 | 1.087 |
| | sodium sulfate | 4.000 | 4.000 |
| Decomposition temperature | | 180°C | 180°C |

EXAMPLE 1

| Example 1 | |
|---|---|
| Sodium lauryl sulfate | 40% by weight |
| Sodium sulfate | 57% by weight |
| Sodium secondary phosphate | 3% by weight |

Water was added to a mixture comprising the above components to form a 50% aqueous slurry, and the slurry was dried so that the water content (% of weight loss when heated at 105°C. for 2 hours) was 5.6%. The dried product was pulverized and passed through a 10-mesh sieve and then a 60 mesh-sieve. The particles left on the 60-mesh sieve were collected.

Hydrogen peroxide adducts as listed below were incorporated into samples of thus-obtained powder neutral detergent base so that the resulting composition consisted of 30% by weight of the adduct and 70% by weight of the detergent base. The composition was stored at a temperature of 40°C. and a relative humidity of 85% for 7 days. The residual amount of available oxygen was determined. The results shown in the following Table were obtained.

| Hydrogen Peroxide Adduct | Ratio of available oxygen remaining after 7 days' storage at 40°C. and RH of 85% (%, based on original available oxygen in the "as prepared" composition) |
|---|---|
| Product of this Invention | |
| $4Na_2SO_4.2H_2O_2.NaCl$ | 92 |
| Comparative Products | |
| $Na_2SO_4 . \frac{1}{2} H_2O_2$ | 0 |
| $(NH_2)_2CO.H_2O_2$ | 10 |
| $Na_2CO_3 . \frac{3}{2} H_2O_2$ | 0 |
| $NaBO_2.H_2O_2.3H_2O$ | 35 |
| $Na_4P_2O_7.H_2O_2$ | 0 |

From the above results it will readily be understood that only $4Na_2SO_4.2H_2O_2.NaCl$ can be stably incorporated into a neutral light-duty detergent.

EXAMPLE 2

The following heavy-duty (alkaline) detergent base A and light-duty (neutral) detergent base B were prepared:

| | Detergent Base A | Detergent Base B |
|---|---|---|
| Sodium dodecylbenzenesulfonate | 20% by weight | 30% by weight |
| Sodium tripolyphosphate | 30% by weight | 0 |
| Sodium carbonate | 10% by weight | 0 |
| Carboxymethyl cellulose | 1% by weight | 0 |
| Sodium p-toluenesulfonate | 3% by weight | 3% by weight |
| Sodium sulfate | 35% by weight | 67% by weight |

Water was added to the sample to obtain a 50% aqueous slurry, and the slurry was dried so that the water content was 10%. The dried product was passed through a 10-mesh sieve and then a 60-mesh sieve. The particles left on the 60-mesh sieve were collected.

These powder detergent bases A and B were subjected to the following experiments (1) and (2):

1. The detergent base was mixed with 20% by weight of sodium percarbonate and 5% by weight of sodium hydrogen sulfate as an agent for reducing the alkalinity, and the mixture was blended in a synthetic resin bottle in a sealed state. In the case of both the base A and the base B, the cap of the bottle was blown off. Since danger was apparent, the experiment was stopped at this stage in each of the bases A and B.

2. The detergent base was mixed with 20% of $4Na_2SO_4.2H_2O_2.NaCl$, and the mixture was stored for 7 days at a temperature of 40°C. and a relative humidity of 85%. Then, the amount of residual available oxygen was measured. The following results were obtained:

| Detergent Base | Residual Available Oxygen (%, based on original) |
|---|---|
| A (heavy-duty detergent base) | 0 |
| B (light-duty detergent base) | 88 |

From the foregoing results, it will readily be understood that $4Na_2SO_4.2H_2O_2.NaCl$ can be incorporated into a light-duty detergent.

EXAMPLE 3

$4Na_2SO_4.2H_2O_2.NaCl$ was incorporated into a detergent comprising 15% by weight of polyoxyethylene (13)-sec-alkyl(C13) ether, 82% by weight of sodium sulfate and 3% by weight of sodium pyrophosphate, in an amount of 10% by weight based on the total composition, thereby to obtain a neutral bleaching detergent composition.

Wool was washed with the thus-obtained composition and also with the same detergent composition not containing the bleaching agent. The detergent composition containing the bleaching agent gave a softer wash finish touch, according to 4 men of a test panel consisting of 5 men.

The washing conditions and the touch-evaluating method were as follows:

Washing Conditions:

The sample cloth was immersed for 30 minutes in an aqueous solution containing 0.2% of the detergent composition and maintained at 40°C., and washed by hand. The washed sample was squeezed by pressing a towel against the sample and then dried in a room.

Touch:

The touch was evaluated by feeling the washed cloth with fingers. The test panel consisted of 5 men.

The embodiments of the invention in which an exclusive property or privilege is claimed are defined as follows:

1. A substantially neutral detergent composition having a pH of about 6 to about 8, consisting essentially of from about 3 to about 40 percent by weight of $4Na_2SO_4.2H_2O_2.NaCl$, from about 3 to about 50 percent by weight of water-soluble anionic surfactant, or water-soluble nonionic surfactant, or water-soluble amphoteric surfactant, or mixtures thereof, from about 10 to about 90 percent by weight of water-soluble neutral inorganic detergent builder or filler salt, from zero to about 20 percent by weight of water-soluble alkaline inorganic detergent builder salt, with the proviso that the amount of said water-soluble alkaline inorganic builder salt is such that the pH of the detergent composition is not higher than about 8, and from zero to about 10 percent by weight of water-soluble organic detergent builder, the detergent composition being free of activator for said $4Na_2SO_4.2H_2O_2.NaCl$.

2. The detergent composition according to claim 1 in which the neutral inorganic salt is sodium sulfate.

3. The composition according to claim 1, containing from 10 to 30 percent by weight of $4Na_2SO_4.2H_2O_2.NaCl$.

* * * * *